United States Patent [19]

Uehara

[11] Patent Number: 4,915,142

[45] Date of Patent: Apr. 10, 1990

[54] WEFT INSERTION CONTROL SYSTEM FOR JET LOOM RESPONSIVE TO INSERTED WEFT END BEHAVIOR

[75] Inventor: Jotaro Uehara, Higashikurume, Japan

[73] Assignee: Nissan Motor Co., Ltd., Yokohama, Japan

[21] Appl. No.: 340,746

[22] Filed: Apr. 20, 1989

[30] Foreign Application Priority Data

Sep. 5, 1988 [JP] Japan ..... 63-220527

[51] Int. Cl.[4] ..... D03D 47/36

[52] U.S. Cl. ..... 139/435.2; 139/116.1

[58] Field of Search ..... 139/116 R, 435, 429, 139/450

[56] References Cited

U.S. PATENT DOCUMENTS 4,744,393 5/1988 Takegawa ..... 139/435

4,830,063 5/1989 Takegawa ..... 139/435

FOREIGN PATENT DOCUMENTS 56-96938 8/1981 Japan .

*Primary Examiner*—Henry S. Jaudon

*Attorney, Agent, or Firm*—Foley & Lardner, Schwartz, Jeffery, Schwaab, Mack, Blumenthal & Evans

[57] ABSTRACT

A weft insertion control system for a jet loom includes a weft yarn sensor for sensing a behavior of a forward end of an inserted weft yarn accurately, and a controlling system for controlling a weft inserting condition such as a fluid jet in accordance with the sensed behavior. The weft yarn sensor is arranged to detect at least one of the following first, second and third conditions. The first condition is a condition in which the picked weft yarn is elongated to a greatest length, and the weft forward end is farthest from a main fluid jet nozzle. The second condition is a condition in which the weft end is pulled back most by shrinkage of the weft yarn after the first condition is reached. The third condition is a condition in which the weft yarn is elongated again to a relative maximum length.

11 Claims, 4 Drawing Sheets

WEFT INSERTION CONTROL SYSTEM FOR JET LOOM RESPONSIVE TO INSERTED WEFT END BEHAVIOR

BACKGROUND OF THE INVENTION

The present invention relates to a weft insertion control system for a jet loom.

Japanese Patent Provisional Publication No. 56-96938 shows a conventional weft insertion control system for a fluid jet loom. This system employs an arrival sensor, disposed on a weft receiving side of a loom, for sensing a flying speed of a forward end of a weft yarn picked by a main nozzle, and controls the weft inserting condition such as fluid pressures and fluid jet timings of the main nozzle and auxiliary fluid jet nozzles.

In this conventional weft insertion control system, however, it is not possible to accurately sense the behavior of the inserted weft end. Therefore, this conventional system is unable to control the weft insertion adequately.

SUMMARY OF THE INVENTION

It is therefore an object of the present invention to provide a fluid jet weft insertion control system which can accurately sense the behavior of the forward end of the weft yarn inserted through the warp shed, and control the weft insertion adequately in accordance with the result of the detection.

According to the present invention, a weft insertion control system for a jet loom, comprises (i) weft inserting means, (ii) controlling means, and (iii) sensing means, as schematically shown in FIG. 8. The weft inserting means is a means for inserting a weft yarn in a weft inserting direction form a weft picking side to a weft receiving side across a warp shed by a fluid jet. The controlling means is a means for adjusting or controlling the weft inserting means in accordance with at least one sensor signal produced by the sensing means. The sensing means is provided on the weft receiving side, for sensing a position of a forward end of the weft yarn inserted through the shed, and producing the above-mentioned sensor signal representing the behavior of the forward end of the weft yarn. The sensing means comprises a detecting element which extends along the weft inserting direction, and which is capable of sensing back and forth movements of the forward end of the weft yarn along the weft inserting direction.

The weft inserting means comprises a main fluid jet nozzle for ejecting the weft yarn into the shed, and the sensing means may be arranged to detect an extreme condition of the weft yarn in which a distance of the forward end of the weft yarn from the main nozzle becomes an extremum (a maximum or a minimum).

The controlling means may comprises first operational means for determining a timing difference between a timing of occurrence of the sensor signal and a predetermined desired reference timing, and second operational means for controlling a weft inserting condition so as to reduce the timing difference to zero or below an allowable level. The system may further comprises a timing sensor for determining the timings in a weaving cycle by sensing a displacement of a regularly moving element of the loom. In this case, the first operational means of the controlling means is connected with the timing sensor. For example, the timing sensor is a rotation angle sensor for sensing an angular displacement of a main shaft of the loom.

DETAILED DESCRIPTION OF THE INVENTION

One embodiment of the present invention is shown in FIGS. 1–7.

Figure 1:
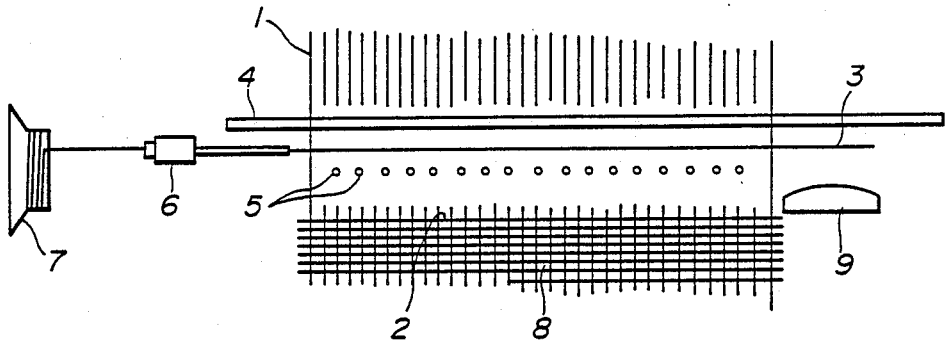
FIG. 1 is a schematic view of a main weft inserting nozzle and a weft yarn sensor, for showing one embodiment of the present invention.
Figure 2:
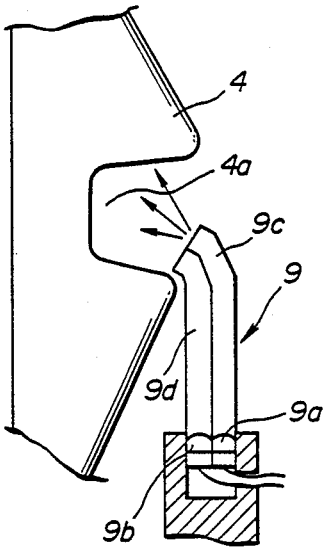
FIGS. 2 and 3 are sectional view and perspective view showing the weft yarn sensor of FIG. 1.
Figure 3:
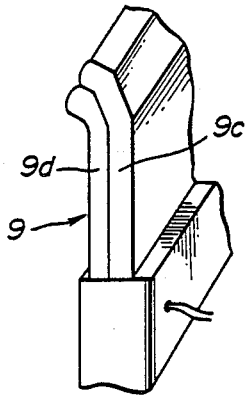

As shown in FIG. 1, warp threads 1 are raised and lowered by heddles (not shown) to form a warp shed in front of a cloth fell 2. A weft yarn 3 inserted into the shed is beaten into a fabric 8 by a reed 4. In the front surface of each dent of the reed 4, there is formed a depression 4*a*, as shown in FIG. 2. The depressions 4*a* of the dents are arranged in a line and form an air guide passage 4*a*. A plurality of auxiliary nozzles 5 are arranged along the air guide passage 4*a*.

The weft yarn 3 is casted by an air jet of a main weft inserting nozzle 6, and guided by the air guide passage 4*a*. The auxiliary nozzles 5 provide auxiliary jets in sequence from a weft picking side, and help the main jet to carry the weft thread 3 across the shed to a weft receiving side of the loom. As shown in FIG. 1, there is further provided a weft storage unit 7 for supplying the weft yarn 3 to the main nozzle 6 in a controlled manner.

The weft insertion control system of this embodiment includes a linear sensor 9 which serves as the detecting element of the sensing means, characteristic of the present invention, for sensing the position of the forward end of the weft yarn 3. The linear sensor 9 is disposed on the weft receiving side of the loom which is opposite to the picking side on which the main nozzle 6 is provided. The linear sensor 9 is elongated along the weft inserting direction, or along the reed 4, as shown in FIG. 1. As shown in FIG. 2, the linear sensor 9 includes a light emitting portion 9*a* made up of at least one light emitting device such as a diode, and a light receiving portion 9*b* made up of at least one light sensitive device such as a diode. Each of the light emitting and receiving portions 9*a* and 9*b* extends along the weft inserting direction. The linear sensor 9 further includes a first and second light transmitting portions 9*c* and 9*d*, each of which is made up of a prism or some other device capable of transmitting light from one end to the other, and elongated along the weft inserting direction. The first light transmitting portion 9*c* extends from the light emitting portion 9*a* toward the air guide passage 4*a* of the reed 4, and serves for transmitting light emitted by the light emitting portion 9*a* to the inside wall surface of the air guide passage 4*a*. The second light transmitting portion 9*d* is arranged to transmit the light reflected from the inside surface of the air guide passage 4*a*, to the light receiving portion 9*b*. With this construction, the linear sensor 9 is capable of sensing the position of the forward end of the inserted weft yarn 3, and monitoring back and forth linear movements of the forward end of the inserted weft yarn 3 along the weft inserting direction.

The linear sensor 9 is connected with a control unit (not shown in FIG. 1) which serves as the controlling means. The control unit is further connected with a rotation angle sensor (not shownn in FIG. 1) for sensing an angular displacement of a main shaft of the loom. In accordance with signals supplied from the linear sensor 9 and the rotation angle sensor, the control unit controls the weft inserting means for varying weft inserting conditions of the main and auxiliary nozzles 6 and 5.

The control system of this embodiment controls the weft insertion in the following manner.

The weft yarn 3 flies along the air guide passage 4*a* from the main nozzle 6 through the warp shed to the weft receiving side by the forces of the air jets of the main nozzle 6 and the auxiliary nozzles 5.

Figure 4:
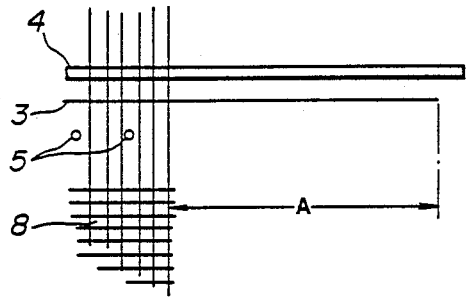
FIGS. 4–6 are schematic views illustrating a behavior of a inserted weft yarn, which is to be detected by the weft yarn sensor of this embodiment.

The flight of the weft yarn 3 terminates when the rotation angle of the main shaft is in the range from about 210° to about 260°. (The rotation angle of the main shaft of the loom is hereinafter referred to as a timing.) FIG. 4 shows the weft yarn 3 at the end of the first flight from the main nozzle 6 to the receiving side. In this condition, the distance A of the forward end of the weft yarn 3 from a reference position becomes maximum. The reference position is the position of the rightmost warp yarn in the example shown in FIG. 4, but it may be the position of the main nozzle 6 on the picking side. In this extreme condition, the tension of the weft yarn becomes greatest, and the weft yarn is elongated to the greatest length.

After the weft yarn reaches the extreme condition shown in FIG. 4, the forward end of the weft yarn 3 starts moving in the reverse direction from the weft receiving side toward the picking side, which is opposite to the weft inserting direction. This reverse movement of the forward end of the inserted weft yarn is caused by shrinkage of the weft yarn 3 due to reaction of the elongation of the weft yarn, and influence of a movement of the reed 4. Thus, the inserted weft yarn 3 becomes slack, and the forward end moves in the reverse direction and reaches an extreme position shown in FIG. 5, at the timing near 240° to 270°. In this position, the distance of the forward end of the inserted weft yarn 3 from the rightmost warp yarn, or from the main nozzle 6 becomes minimum.

Figure 5:
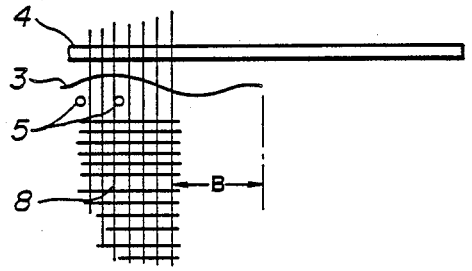

After this minimum condition of FIG. 5 is reached, the weft yarn 3 is elongated again by a residual wind of the air jets and other factors in the region of the timing from about 250° to about 300°. Therefore, the forward end of the weft yarn 3 moves again in the weft inserting direction, and reaches an extreme position shown in FIG. 6 shortly before the inserted weft yarn 3 is formed into the fabric 8. In this position, the distance of the forward end of the weft yarn 3 from the reference position is increased to a relative maximum, as shown by C in FIG. 6.

Figure 6:
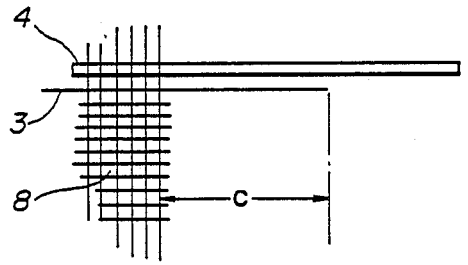

The linear sensor 9 of this embodiment detects these conditions shown in FIGS. 4, 5 and 6, and sends signals to the control unit. In response to the signals of the linear sensor 9, the control unit controls the weft inserting condition such as the fluid pressure and duration of the fluid jet of the main nozzle 6 or those of the auxiliary nozzles 5.

Figure 7:
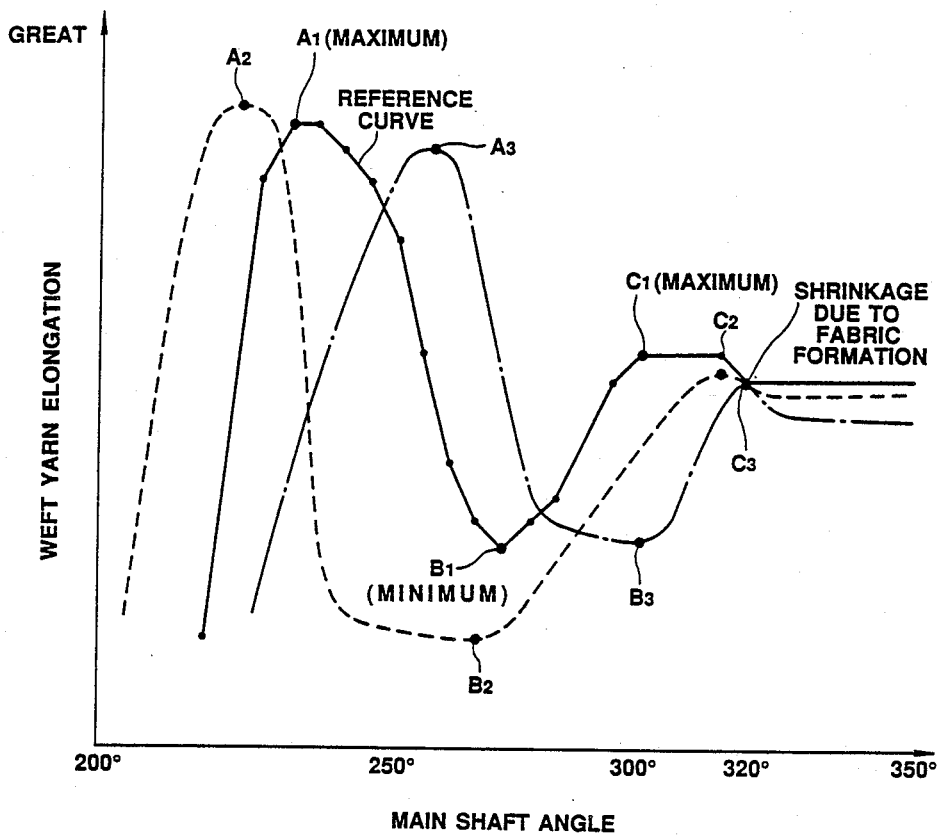
FIG. 7 is a graph showing relationships between the elongation of the inserted weft yarn and the angular displacement of the loom main shaft, which are used in the embodiment of the invention.
Figure 8:
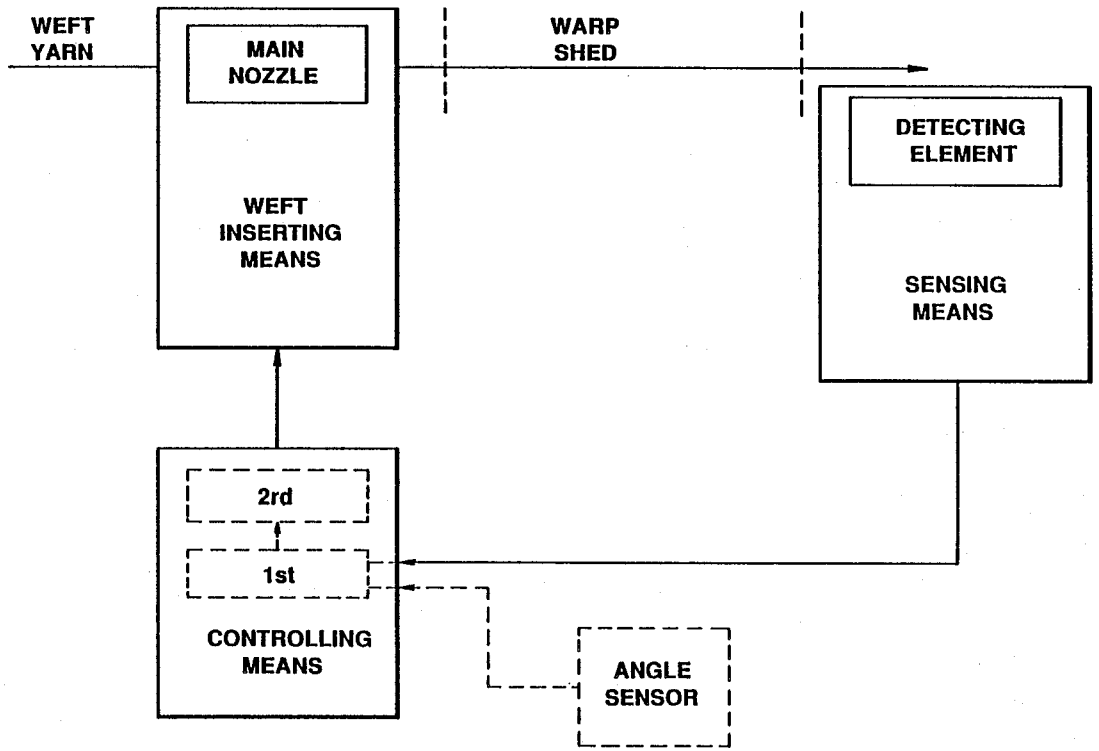

In this embodiment, the control unit compares the behavior of the forward end of the inserted weft yarn 3 sensed by the liner sensor 9, with a desired reference behavior shown by a reference curve of a solid line in FIG. 7. This reference curve includes a first maximum position $A_1$ corresponding to the condition of FIG. 4, a minimum position $B_1$ corresponding to the condition of FIG. 4, and a second maximum position $C_1$ corresponding to the condition of FIG. 6. If the first maximum position, the minimum position and the second maximum position actually sensed by the linear sensor 9 are respectively located at positions $A_2$, $B_2$ and $C_2$ on a broken line curve in FIG. 7, then the actual behavior of the forward end of the inserted weft yarn 3 leads, in time, the reference behavior shown by the reference curve. In this case, the control system of this embodiment decreases the fluid pressure, and/or the duration of, the fluid jet of the main nozzle 6, and/or the auxiliary nozzles 5 so as to retard the behavior of the weft yarn end. (However, the timing of start of the fluid jet is held constant.) Therefore, the actual behavior of the weft yarn end is made closer to the desired reference behavior.

An actual behavior shown by a one dot chain line in FIG. 7 lags the reference behavior in time. This curve has the first maximum position, the minimum position and the second maximum position, respectively, at $A_3$, $B_3$ and $C_3$. If such a behavior is detected, then the control system of this embodiment increases the fluid pressure and/or the duration of the fluid jet of the main nozzle 6, (and/or each auxiliary nozzle 5) (by holding the timing of start of the fluid jet unchanged). Therefore, the behavior of the inserted weft end is advanced toward the desired reference behavior.

In this way, the control system of the present invention senses the behavior of the inserted weft yarn end accurately, and controls the weft insertion in accordance with the behavior of the weft yarn end, so that the system of the invention can improve the quality of woven fabric.

It is optional to employ a plurality of weft yarn detecting elements arranged in the weft inserting direction, instead of the linear sensor in a single body.

What is claimed is:

1. A weft insertion control system for a jet loom, comprising:

weft inserting means for inserting a weft yarn in a weft inserting direction from a picking side to a receiving side across a shed by a fluid jet, controlling means for adjusting said weft inserting means in accordance with a sensor signal, and sensing means provided on said receiving side for sensing positions of the forward end of a weft yarn inserted through said shed, said sensing means producing said sensor signal, said sensing means comprising a detecting element at said receiving side extending along said weft yarn inserting direction and being capable of sensing back and forth movements of said forward end of said weft yarn along said weft inserting direction.

2. A weft insertion control system according to claim 1 wherein said sensing means includes means for sensing a reverse movement of said forward end of said weft yarn in a reverse direction opposite to said weft inserting direction.

3. A weft insertion control system according to claim 1 wherein said weft inserting means comprises a main fluid jet nozzle for ejecting said weft yarn into said shed, and said sensing means includes means for detecting an extreme condition of said weft yarn in which a distance of said forward end of said weft yarn from said main nozzle reaches a maximum position.

4. A weft insertion control system according to claim 1 wherein said weft inserting means comprises a main fluid jet nozzle for ejecting said weft yarn into said shed, said sensing means includes means for sensing one of first, second and third positions of said forward end of said weft yarn, said first position being a position at which said distance of said forward end of said weft yarn from said main nozzle first reaches a maximum after an ejection of said weft yarn from said main nozzle, said second position being a position at which said distance first reaches a minimum after the ejection, and said third position being a position at which said distance becomes a maximum again.

5. A weft insertion control system according to claim 3 wherein said weft inserting means comprises a main fluid jet nozzle for ejecting said weft yarn into said shed, said sensing means includes means for detecting one of first, second and third extreme conditions of said weft yarn inserted through said shed, said first extreme condition being a condition in which a first forward movement of said forward end of said weft yarn from said main nozzle in said weft inserting direction terminates, and a subsequent reverse movement of said forward end of said weft yarn begins in a reverse direction opposite to said weft inserting direction because of reactive shrinkage of said weft yarn, said second extreme condition being a condition in which said subsequent reverse movement terminates, and a second forward movement of said forward end of said weft yarn begins, and said third condition being a condition in which said seeond forward movement terminates, and said forward end of said weft yarn starts moving in said reverse direction again.

6. A weft insertion control system according to claim 5 wherein said sensing means includes means for producing said sensor signal at a time instant when one of said first, second and third extreme condition is detected.

7. A weft insertion control system according to claim 6 wherein said controlling means comprises first operational means for determining a timing difference between a timing of occurrence of said sensor signal and a predetermined reference timing, and second operational means for controlling a weft inserting condition of said weft inserting means so as to reduce said timing difference.

8. A weft insertion control system according to claim 7 wherein said system further comprises a timing sensor for determining said timings by sensing a displacement of a regularly moving element of said loom, and said first operational means of said controlling means is connected with said timing sensor.

9. A weft insertion control system according to claim 7 wherein said controlling means increases a fluid pressure used by said main nozzle when said occurrence of said sensor signal lags said reference timing, and decreases said fluid pressure when said timing of occurrence of said sensor signal leads said reference timing.

10. A weft insertion control system according to claim 7 wherein said controlling means increases a fluid jet duration when said occurrences of said sensor signal lags said reference timing, and decreases said fluid jet duration when said timing of occurrence of said sensor signal leads said reference timing.

11. A weft insertion system according to claim 6 wherein said detecting element is a linear sensor.

* * * * *